US006199456B1

(12) United States Patent
Hlady

(10) Patent No.: US 6,199,456 B1
(45) Date of Patent: Mar. 13, 2001

(54) APPARATUS FOR HOLDING AND MANIPULATING TOOLS

(76) Inventor: Todd H. Hlady, 4417 Marsh Elder Ct., Concord, CA (US) 94520

( * ) Notice: Subject to any disclaimer, the term of this patent is extended or adjusted under 35 U.S.C. 154(b) by 0 days.

(21) Appl. No.: 09/416,712

(22) Filed: Oct. 12, 1999

(51) Int. Cl.[7] ..... B25B 23/16

(52) U.S. Cl. ..... 81/177.2; 81/180.1; 81/125.1

(58) Field of Search ..... 81/177.2, 177.1, 81/177.5, 462, 180.1, 184, 125.1, 124.4; 269/69; 254/131, DIG. 3

(56) References Cited

U.S. PATENT DOCUMENTS

| | | | | |
|---|---|---|---|---|
| D. 53,597 | * | 7/1919 | Marcmann | 81/124.4 X |
| 798,325 | * | 8/1905 | Daddysman, Jr. | 81/125.1 |
| 1,226,228 | * | 5/1917 | McKinzie | 81/125.1 |
| 3,057,617 | * | 10/1962 | Sealander | 269/69 X |
| 3,546,919 | * | 12/1970 | Fial | 254/131 X |
| 4,305,316 | * | 12/1981 | Lehman | 81/180.1 |
| 4,519,278 | * | 5/1985 | Heldt | 81/124.4 X |
| 4,733,583 | | 3/1988 | Lewis . | |
| 4,774,736 | * | 10/1988 | Brawner et al. | 81/437 X |
| 5,086,674 | * | 2/1992 | Her | 81/124.4 |
| 5,251,519 | | 10/1993 | Lang . | |
| 5,570,617 | | 11/1996 | Love . | |
| 5,613,411 | | 3/1997 | Rines . | |
| 6,058,814 | * | 5/2000 | Johnson | 81/177.2 |

* cited by examiner

*Primary Examiner*—D. S. Meislin
(74) *Attorney, Agent, or Firm*—Thomas R. Lampe

(57) ABSTRACT

A manually operable device for applying leverage to a tool or other object includes a double-ended elongated member having tube-like receptacles attached to the ends thereof. The receptacles have a plurality of openings formed therein for alternatively accommodating an object. One of the tubes is orthogonal to the primary axis of the elongated member and another is canted relative to the primary axis of the elongated member.

13 Claims, 2 Drawing Sheets

10
12
14
16
18
20
24
26
28
30
36
40

APPARATUS FOR HOLDING AND MANIPULATING TOOLS

TECHNICAL FIELD

This invention relates to a manually operable device for connection to tools or other objects to apply leverage thereto.

BACKGROUND OF THE INVENTION

Ratchet wrenches and other wrenches or tools occasionally prove inadequate to the task of threading or unthreading nuts, bolts and the like due to the fact that the user cannot apply the torque necessary to accomplish the job. This becomes a problem, for example, when the tool is in a confined or restricted area, making it difficult for an individual to apply the necessary degree of leverage.

It is known to insert straight pipes over the handles of ratchet wrenches and other wrenches or tools to increase the leverage applied to the tool and the nut or bolt to which it is applied. Such an approach is not suitable in all situations since the straight pipe can be utilized only when there is sufficient clearance to allow movement of the pipe, which of course is usually coaxial with the handle of the tool.

U.S. Pat. No. 5,570,617, issued Nov. 5, 1996, discloses an extendable extension handle for wrenches, ratchets, tire irons and such to permit the user to increase the leverage applied to the tool. The device is straight and extends coaxially with the handle of the wrench, ratchet or the like.

U.S. Pat. No. 4,733,583, issued Mar. 29, 1988, discloses a lug wrench for loosening and tightening lug nuts on a vehicle wheel which incorporate a moment arm bar and a multiplier bar pivotally connected together to change the mechanical advantage when loosening or tightening the lug nut.

U.S. Pat. No. 5,613,411, issued Mar. 25, 1997, discloses a tool for emergency use during changing a tire alongside a roadway which includes a socket and extension therefor. An inclined support member urges the socket into lug nut engagement during tool use when downward force is exerted on an arm on the extension. Projections on the support member penetrate the ground surface to prevent slippage of the member.

U.S. Pat. No. 5,254,519, issued Oct. 12, 1993, discloses a wrench kit for servicing threaded components such as nuts and bolts that are not easily accessible. The kit consists of a wrench member and a plurality of heads releasably engageable by the wrench member. The wrench member has a shaft elongated between proximal and distal extremities. An operational block, disposed at the distal extremity, is capable of securing a head in orthogonal relationship to the shaft. The proximal extremity is provided with a straight turning handle that penetrates the shaft in T-shaped relationship.

DISCLOSURE OF INVENTION

The present invention relates to a manually operable device for receiving tools or other objects having elongated, manually graspable portions and for applying leverage thereto. The device is characterized by its simplicity, relatively low cost, and versatility of use.

The device includes a double-ended elongated member having a primary axis.

A double-ended first receptacle is at one of the ends of the elongated member and defines a first pair of openings. The two openings of the first pair of openings are spaced from one another and disposed at the ends of the first receptacle. The openings lead to a recess defined by the first receptacle for receiving and holding tools or other objects with the elongated, manually graspable portions thereof disposed orthogonally relative to the primary axis of the elongated member.

The device also includes a double-ended second receptacle at the other of the ends of the elongated member defining a second pair of openings. The two openings of the second pair of openings are spaced from one another and are disposed at the ends of the second receptacle and lead to a recess defined by the second receptacle for receiving and holding tools or other objects with the elongated, manually graspable portions thereof being angularly disposed relative to the primary axis of the elongated member.

Such an arrangement allows a tool or other object to be approached from a plurality of angles depending upon the circumstances presented.

Other features, advantages, and objects of the present invention will become apparent with reference to the following description and accompanying drawings.

BEST MODE FOR CARRYING OUT THE INVENTION

Figures 1, 2, 3, 4:
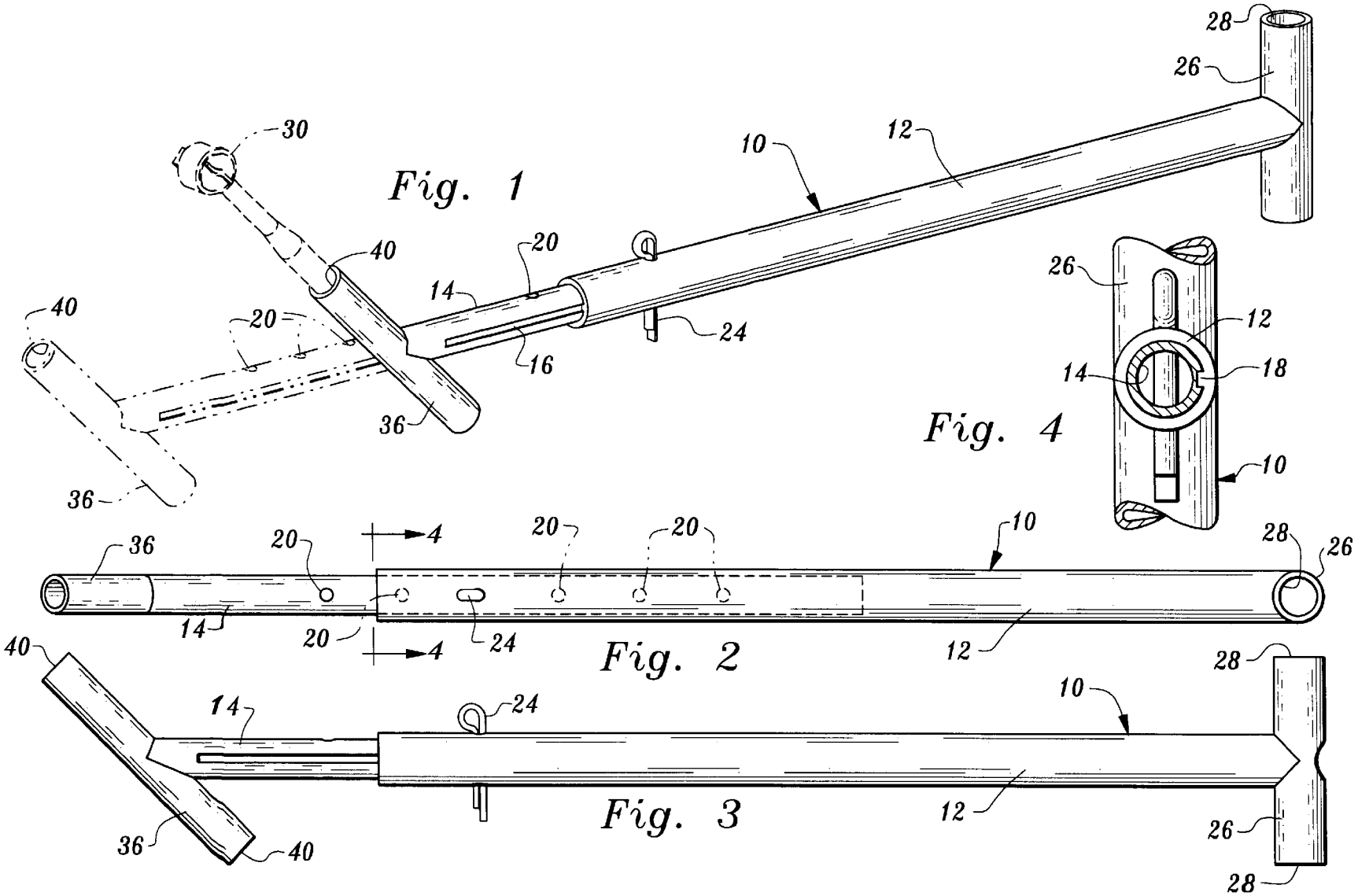
FIG. 1 is a perspective view of a device constructed in accordance with the teachings of the present invention, with solid line and dash lined depictions showing two alternative configurations of the device, a ratchet wrench being illustrated in dash lines in the solid line depiction of the device.
FIG. 2 is a top plan view of the device.
FIG. 3 is a side elevational view of the device.
FIG. 4 is a greatly enlarged, partial sectional view taken along the line 4—4 in FIG. 2.

Referring now to the drawings, a device constructed in accordance with the teachings of the present invention is illustrated. The device includes a double-ended elongated member 10 including an elongated member segment 12 of tubular construction and an elongated member segment 14 slidably, telescopically disposed within elongated member segment 12. An elongated keyway 16 formed in elongated member segment 14 cooperates with a key 18 projecting from the inner wall of elongated member segment 12 to prevent relative rotational movement between the elongated member segments.

A plurality of apertures 20 are formed in opposed sides of the elongated member segment 14 in registry with one another, only the apertures on one side of the elongated member segment 14 being shown in the drawings in the interest of simplicity. One set of registered apertures 22 is defined by the elongated member segment 12 (see FIG. 7 wherein one such aperture 22 is shown in the upper side of the elongated member segment 12).

Sliding movement between the elongated member segments brings alternate sets of apertures 20 into alignment with apertures 22. A cotter pin 24 is insertable into aligned apertures 20, 22 to lock the elongated member segments against relative slidable movement. FIG. 1 shows the elongated member in two representative configurations, one longer than the other, by a solid line depiction and a dash line depiction. It will thus be seen that the effective overall length of the elongated member can be quickly and readily adjusted.

Attached to an end of elongated member segment 12 is a receptacle in the form of a hollow tube 26, welding or other known means being employed to affix the elongated member segment and tube together. Openings 28 are formed at the ends of tube 26, the openings leading to the interior or recess defined by tube 26. The tube 26 is orthogonally disposed relative to the primary axis of elongated member 10.

Figures 5, 6, 7, 8, 9:
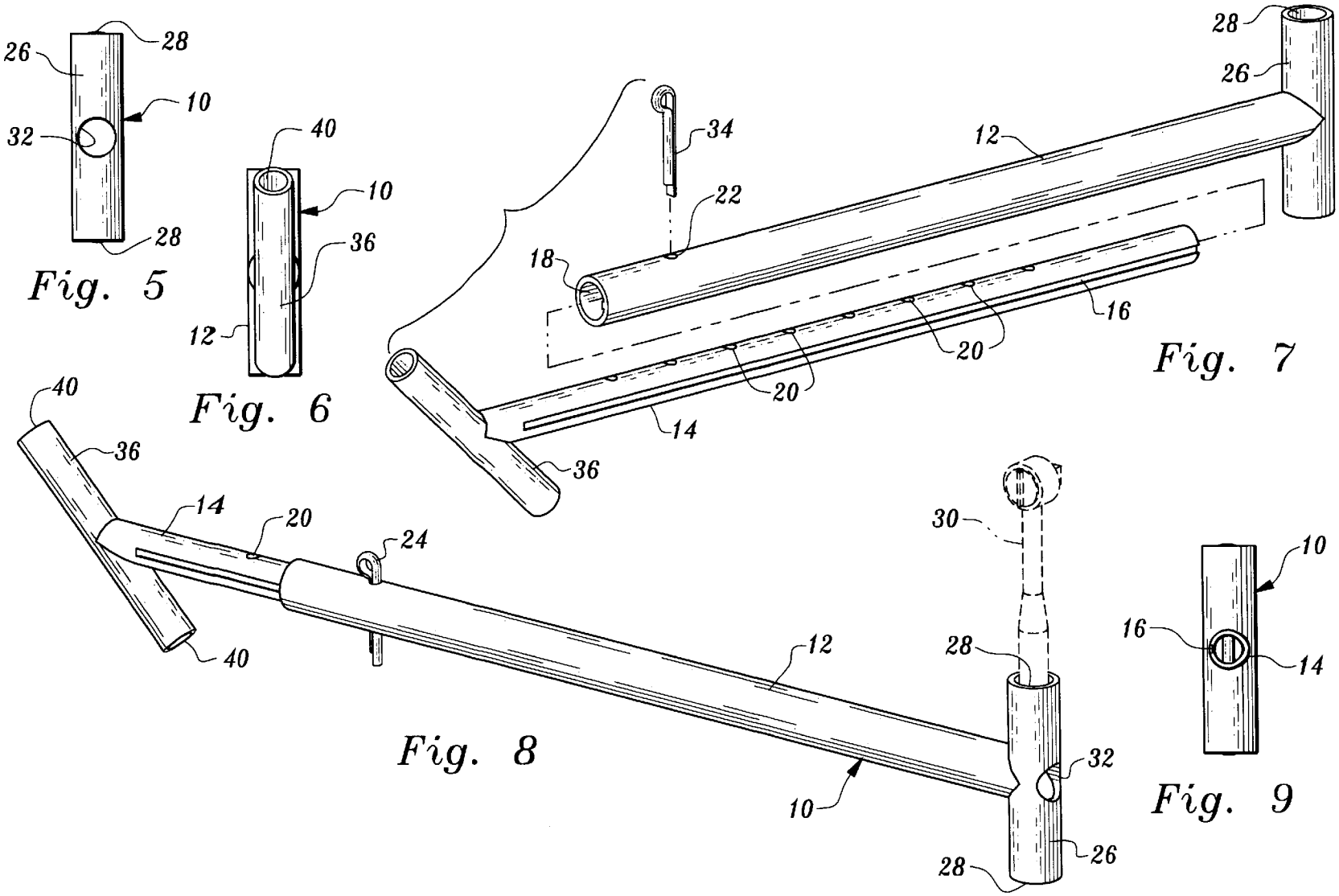
FIG. 5 is an end view of the device as taken from the right hand end of the device as depicted in FIG. 1.
FIG. 6 is a view similar to FIG. 5, but taken from the left hand end of the device as depicted in FIG. 1.
FIG. 7 is an exploded, perspective view of the device.
FIG. 8 is a perspective view of the device illustrating a ratchet wrench, depicted in dash lines, located in an opening other than that accommodating the ratchet wrench in FIG. 1.
FIG. 9 in an and view of an elongated member segment incorporating a keyway.

Each of the openings 28 can receive therein the elongated, manually graspable portion of a tool or other object and hold the elongated, manually graspable portions orthogonal relative to the primary axis of the elongated member. FIG. 8, for example, illustrates the handle of a ratchet wrench 30 disposed in one of the openings 28 and the tube interior so that the device can be utilized to apply leverage to the wrench.

Another opening 32 is formed in tube 26 which is in alignment with the primary axis of elongated member segment 12 of the elongated member. The opening 32 communicates with the interior of elongated member segment 12 so that a tool or other object can be positioned and held with the elongated, manually graspable portion thereof coaxial with the primary axis of the elongated member.

Another double-ended receptacle, hollow tube 36, is attached to the opposite end of elongated member 10 on elongated member segment 14. Tube 36 is angularly disposed or canted relative to the elongated member segment 14, a preferred angle of cant being 45 degrees, with one portion of the tube 36 defining an acute angle with the elongated member and another portion thereof defining an obtuse angle with the elongated member.

Openings 40 are formed at the ends of tube 36 to receive elongated, manually graspable portions of tools or the like. FIG. 1 illustrates the handle of a ratchet wrench 30 in position in one of the openings 40.

It will be appreciated that the individual using the device of this invention has a number of choices insofar as attaching the device to a tool or other object is concerned. The choice made will depend upon the circumstances encountered. For example, it may be more efficient, practical, or even necessary, to use the angled tube 36 in lieu of tube 26 or vice versa, to provide the best mechanical advantage.

What is claimed is:

1. A manually operable device for receiving tools or other objects having elongated, manually graspable portions and for applying leverage thereto, said device comprising, in combination:

a double-ended elongated member having a primary axis;

a double-ended first receptacle attached to one of the ends of said elongated member defining a first pair of openings, the two openings of said first pair of openings being spaced from one another, disposed at the ends of said first receptacle and leading to a recess defined by said first receptacle for receiving and holding tools or other objects with the elongated, manually graspable portions thereof disposed substantially orthogonally relative to the primary axis of said elongated member; and a double-ended second receptacle attached to the other of the ends of said elongated member defining a second pair of openings, the two openings of said second pair of openings being spaced from one another, disposed at the ends of said second receptacle and leading to a recess defined by said second receptacle for receiving and holding tools or other objects with the elongated, manually graspable portions thereof being angularly disposed relative to the primary axis of said elongated member, a least one of said receptacles defining a third opening in alignment with the primary axis of said elongated member, said elongated member defining an interior and said third opening communicating with said interior for holding a tool or other object with the elongated, manually graspable portion thereof substantially coaxial with the primary axis of said elongated member.

2. The device according to claim 1 wherein said elongated member includes a first elongated member segment and a second elongated member segment, said elongated member segments being slidably, telescopically mounted relative to one another for changing the overall length of said elongated member.

3. The device according to claim 2 additionally comprising lock means for selectively locking said elongated member segments against slidable movement.

4. The device according to claim 2 additionally comprising rotation prevention means for preventing rotational movement between said elongated member segments.

5. The device according to claim 4 wherein said rotation prevention means comprises a key connected to one of said elongated member segments and an elongated keyway on the other of said elongated member segments receiving said key.

6. The device according to claim 3 wherein said elongated member segments define selectively registrable apertures, said lock means comprising a lock member selectively positionable in said apertures.

7. The device according to claim 1 wherein said first receptacle and said second receptacle each comprise hollow tubes.

8. The device according to claim 2 wherein at least one of said elongated member segments comprises a hollow tube.

9. The device according to claim 2 wherein said first receptacle is affixed to said first elongated member segment and said second receptacle is affixed to said second elongated member segment.

10. The device according to claim 1 wherein said second receptacle is canted at a substantially 45 degree angle relative to the primary axis of said elongated member.

11. The device according to claim 7 wherein said hollow tubes are affixed to said elongated member between their respective openings.

12. The device according to claim 1 wherein a portion of said second receptacle defines an acute angle with said elongated member and wherein another portion of said second receptacle defines an obtuse angle with said elongated member.

13. The device according to claim 6 wherein said lock member is a cotter pin.

* * * * *